US006600463B2

(12) United States Patent
Kim

(10) Patent No.: US 6,600,463 B2
(45) Date of Patent: Jul. 29, 2003

(54) METHOD OF DRIVING A PLASMA DISPLAY PANEL

(75) Inventor: Min Chul Kim, Kyungsangbuk-do (KR)

(73) Assignee: Orion Electric Co., Ltd., Kyungsangbuk-do (KR)

( * ) Notice: Subject to any disclaimer, the term of this patent is extended or adjusted under 35 U.S.C. 154(b) by 0 days.

(21) Appl. No.: 10/017,796

(22) Filed: Dec. 12, 2001

(65) Prior Publication Data

US 2002/0080098 A1 Jun. 27, 2002

Related U.S. Application Data

(62) Division of application No. 09/451,813, filed on Nov. 30, 1999.

(30) Foreign Application Priority Data

Nov. 30, 1998 (KR) ..... 98-52067
Nov. 30, 1998 (KR) ..... 98-52068

(51) Int. Cl.[7] ..... G09G 3/28

(52) U.S. Cl. ..... 345/60; 345/63; 345/67; 313/306

(58) Field of Search ..... 345/60, 63, 66, 345/67, 68; 313/306, 308

(56) References Cited

U.S. PATENT DOCUMENTS 5,874,932 A * 2/1999 Nagaoka et al. ..... 345/60
6,064,356 A * 5/2000 Shigeta ..... 345/204
6,072,448 A * 6/2000 Kojima et al. ..... 345/63
6,107,978 A * 8/2000 Nagaoka et al. ..... 345/60
6,320,560 B1 * 11/2001 Sasaki et al. ..... 315/169.1

FOREIGN PATENT DOCUMENTS

JP 5-313598 11/1993

* cited by examiner

*Primary Examiner*—Amare Mengistu
*Assistant Examiner*—Jimmy H. Nguyen
(74) *Attorney, Agent, or Firm*—Merchant & Gould P.C.

(57) ABSTRACT

A method of displaying a halftone image on a PDP display unit by using a frame division technique, the method comprising selecting display lines whose number is identical to the total number of said divided subfields, addressing for designating pixels of selected display lines to be displayed and displaying each subfield allocated for the said selected display lines; shifting by a predetermined number of display lines from said selected display lines for at least a sustain pulse period unit, selecting display lines, addressing for designating pixels to be displayed and displaying each subfield allocated for the said selected display lines; and repeating said shifting, said selecting, said addressing and said displaying steps until each of the subfields is completely displayed for all display lines; wherein display lines for which all subfields of one frame have been completely displayed for an idle period. According to the present invention, there is provided a driving method capable of preventing images in two frames from being viewed overlapped to a viewer when displaying a dynamic image by clarifying a boundary between adjacent frames in a multiscan driving method within a sustaining pulse period.

2 Claims, 12 Drawing Sheets

METHOD OF DRIVING A PLASMA DISPLAY PANEL

This application is a divisional of application Ser. No. 09/451,813, filed Nov. 30, 1999, which application(s) are incorporated herein by reference.

FIELD OF THE INVENTION

The present invention relates to a method of driving a plasma display panel and more particularly, to a method of driving an AC-type plasma display panel for displaying a dynamic image without intensity level disturbance and false color contours in a multi-scan driving method within a sustaining pulse period.

BACKGROUND OF THE INVENTION

Recently, a plasma display panel (referred to as "PDP" hereinafter) has advantageous characteristics capable of being utilized as a direct-view large HDTV display apparatus having large screen size but a small thickness and a wide viewing angle compared to other flat display devices.

A PDP is classified into a two-electrode type PDP in which an address discharge and a sustain discharge are performed by two electrodes and a three-electrode type PDP in which an address discharge and a sustain discharge are performed by three electrodes.

FIG. 1 is a schematic sectional view of a discharge cell of a typical PDP and FIG. 2 is a plan view of a three-electrode type of PDP.

The discharge cell 10 of the three-electrode type PDP 1 comprises two glass plates 12 and 13 arranged to be facing each other. On the first glass plate 13 the first electrode 14 (X electrode) and the second electrode 15 (Y electrode) are formed and arranged parallel to each other. The electrodes function as sustain electrodes. The first and second electrodes 14 and 15 are covered with a dielectric layer 18. The upper surface of the dielectric layer 18 is covered with a MgO layer 21, which protects the dielectric layer 18.

On the second glass plate 12 a third electrode 16 is arranged orthogonal to the first and second electrodes 14 and 15. The third electrode functions as a data electrode. A barrier rib 17 of a lattice or stripe shape is formed between the two glass plates 12 and 13 to define a discharge cell. A phosphor material 19 is coated on the surface of the third electrode and the inner surface of the barrier rib.

As shown in FIG. 2, a PDP display device using such three-electrode type PDP comprises a plurality of X electrodes and Y electrodes arranged parallel to each other and wherein Y electrodes are driven independently by separate Y scan driving circuits 4- to 4-n coupled to a Y electrode sustain driving circuit and X electrodes are coupled in common and are driven by a common X electrode driving circuit 5.

Data electrodes 16-1 to 16-n arranged to be orthogonal to the X and Y electrodes are driven by a data driving circuit 6. Also, each of separate Y electrode scan driving circuits 4-1 to 4-n is coupled to the Y electrode sustain driving circuit 3 and generates a scan pulse and sustain pulse.

The Y electrode sustain driving circuit 3 generates a sustain discharge pulse and the generated sustain discharging pulse is applied to the Y electrodes 15-1 to 15-n via the separate Y scan driving circuits 4-1 to 4-n.

The common X electrode driving circuit 5 generates a sustaining pulse which is applied to the X electrodes.

The driving circuits 3, 5 and 6 are controlled by a control circuit (not shown) which is in turn controlled sequentially by a synchronization signal and then a display data signal. In FIG. 2, numeral 1 denotes a PDP and numeral 10 denotes a cell constructing the PDP 1.

There have been proposed several driving methods for a multi-gradation display of such plasma display device. As an example, U.S. Pat. No. 5,541,618 (assigned to Fujitsu Limited.) discloses a driving method in which a frame displaying a single picture is divided into a plurality of subfields and each of the subfields is separated in an addressing period and a sustain period and in each of the subfields, after addressing, a sustaining operation is carried out to all display electrodes at the same time.

FIG. 3 shows a frame structure illustrating a conventional driving method. When scan lines are 480, a frame of a single picture is divided into eight subfields, and a time taken to perform an addressing operation within a frame of a single picture is approximately 11 to 12 microseconds.

Substantially, since a display time (sustaining time) when a viewer can view an image is approximately 5 to 6 microseconds, a display period (sustaining period) that contributes to the brightness of an image is only approximately 30%, resulting in a deterioration of picture brightness. In this case, increasing a frequency of sustain pulse in order to compensate for such deterioration of image brightness can be considered, however, it also causes an increase of the power consumption and a deterioration of driving reliability.

The present applicant has suggested a new driving method capable of solving such problems encountered by the conventional driving method (see PCT/KR98/00204 filed in the name of the present applicant). According to a basic feature of the above-suggested driving method, a frame is divided into a plurality of subfields, and display lines corresponding to the total number of the divided subfields are selected. Then, scan pulses corresponding to the total number of the divided subfields are applied sequentially within a single sustain pulse applied to Y scan sustain electrodes and thereby cells of selected display lines to be displayed are designated. Thereafter, the designated cells of selected display lines are displayed by the following sustain pulse.

Next, after one sustain pulse period, display lines which are downwardly or upwardly shifted from the above selected display lines by one line are selected. Then, scan pulses corresponding to the total number of the divided subfields are applied sequentially within a single sustain pulse applied to Y scan sustain electrodes and thereby cells of selected display lines to be displayed are designated. Thereafter, the designated cells of selected display lines are displayed by following sustain pulse. Continuously, by repeating the display of the subfields for the display lines by shifting one line as a unit one sustain pulse period until each of the subfields for all display lines are completely displayed, the display for a frame is completed.

In this manner, a feature of the above driving method enables scanning of other display lines simultaneously by sustaining them. In order to realize it most suitably, the number of sustain pulses for one frame should be set to be equal to that of the display lines. Also, when selecting display lines, positioning of selected display lines should be determined by considering the number of sustain pulses for each of the subfields.

Now, a feature of the above driving method will be described in detail with reference to FIGS. 4 and 5. For convenience of the description, it assumed that a single frame is divided into three subfields (SF1, SF2, and SF3) and display lines are 7 lines (D1 to D7). Accordingly, it is possible to establish sustain periods in subfields SF1, SF2, and SF3 to 1, 2 and 4, respectively.

Also, regarding the position of the display line selected firstly, it is possible to select the display lines D1, D3 and D7 in consideration of the sustain periods set for the subfields SF1, SF2 and SF3. In FIG. 4, S1 to S7 represent sustain periods.

As shown in FIG. 4, firstly, display lines D1, D3 and D7 are selected, and then the display of the subfields SF1, SF2 and SF3 for display lines D1, D3 and D7 are executed respectively. Next, selecting display lines D2, D4 and D1, which are allocated downwardly by one display line from the above selected display lines D1, D3 and D7, and then the display of the subfields SF1, SF2 and SF3 for display lines D2, D4 and D1 are executed respectively. Next, selecting display lines D3, D5 and D2, which are allocated downwardly by one display line from the above selected display lines D2, D4 and D1, and then the display of the subfields SF1, SF2 and SF3 for display lines D3, D5 and D2 are executed respectively. Next, selecting display lines D4, D6 and D3, which are allocated downwardly by one display line from the above selected display lines D3, D5 and D2, and then the display of the subfields SF1, SF2 and SF3 for display lines D4, D6 and D3 are executed respectively. Next, selecting display lines D5, D7 and D4, which are allocated downwardly by one display line from the above selected display lines D4, D6 and D3, and then the display of the subfields SF1, SF2 and SF3 for display lines D5, D7 and D4 are executed respectively. Next, selecting display lines D6, D1 and D5, which are allocated downwardly by one display line from the above selected display lines D5, D7 and D4, and then the display of the subfields SF1, SF2 and SF3 for display lines D6, D1 and D5 are executed respectively. Finally, selecting display lines D7, D2 and D6, which are allocated downwardly by one display line from the above selected display lines D6, D1 and D5, and then the display of the subfields SF1, SF2 and SF3 for display lines D7, D2 and D6 are executed respectively.

At this time, the display of a previous frame for each of the display lines is completed together with selecting display lines for displaying the next frame, and then the display of the subfields of the next frame for display lines are executed. Thereby, the display of the subfields of the next frame and the display of the subfields of the previous frame are overlapped at the same time. In FIG. 4, when display lines D2, D4, D5 and D6 display subfields SF2, SF3, SF3 and SF3 of the previous frame, respectively, other display lines D1, D3 and D7 display subfields SF1, SF2 and SF3 of the next frame, respectively.

FIG. 5 is a pulse waveform diagram applied to each electrode in order to display the frame as shown in FIG. 4, and illustrates a driving in accordance with a select erase scheme.

First, display lines D1, D3 and D7 whose number is identical to that of the divided subfields are selected, and then the display of the subfields SF1, SF2 and SF3 for the selected display lines D1, D3 and D7 are executed respectively. In other words, by applying a negative write pulse to Y electrodes (Y1, Y2 and Y3) constituting the selected display lines D1, D3 and D7 and applying a positive pulse to common X electrodes, a write discharge for all cells of the selected display lines D1, D3 and D7 is performed.

Thereafter, within one sustain period, scan pulses generated from Y scan-driving circuit are sequentially applied to the selected Y electrodes (Y1, Y2 and Y3). At the same time, data pulses generated from the data driving circuit in accordance with input image data to be displayed are applied to the data electrodes.

If explaining the above state using a discharging principle, as a result of the above write discharge, (+) wall charge is accumulated on a dielectric layer covering Y electrodes and (−) wall charge is accumulated on a dielectric layer covering common X electrodes. Then, if applying a scan pulse and data pulse thereto, the accumulated wall charge is erased. Accordingly, the wall charge on the display lines applied data pulse is erased. Thus, even though a sustain pulse is applied to the common X electrodes and Y electrodes, sustain discharge between the common X electrodes and Y electrodes is not performed. However, since the wall charge is accumulated on the display line to which no data pulse is applied, sustain discharge is performed.

Next, in the next sustain period, the negative write pulses and the positive pulse are applied to the Y electrodes (Y2, Y4, and Y1) and the common X electrode of display lines D2, D4 and D1 respectively, which is allocated downwardly by one display line from the above selected display lines D1, D3 and D7. Then, scan pulses generated from the Y scan-driving circuit are sequentially applied to the selected Y electrodes (Y2, Y4 and Y1). At the same time, data pulses generated from the data driving circuit in accordance with the input image data to be displayed are applied to the data electrodes. At this time, by applying the write pulses to the Y electrodes (Y2, Y4 and Y1) of the display lines (D1, D3 and D7) which are selected in the next sustain pulse period, the display of the selected display line (D1) in the previous sustain pulse period is finished. As a result, the display of a subfield (SF1) for the selected display line (D1) in the previous sustain pulse period is completed. In this way, setting of each of the subfields to each of the selected display lines is determined in advance in accordance with the position of the display lines selected firstly.

Continuously, by repeating the display of the subfields for the selected display lines by shifting one line as an unit of one sustain pulse period until each of the subfields for all display lines is completely displayed, the display for a frame is completed. Finally, the display lines, which have completed all subfields of one frame, will end their sustain discharges by applying a write pulse to display subfields of the next frame.

Accordingly, since within the period of one frame, it can perform simultaneously addressing (scan) of another display line during sustain period of one display line, such driving method can perform display with high efficiency.

As shown in FIGS. 4 and 5, however, such driving method has a problem that during at least a predetermined time, continuous two frames are displayed simultaneously. That is, as shown in FIG. 5, before finishing completely an image display of the first frame F1, an image display of the second frame F3 is performed.

As a result, a mixing display period FH is produced, resulting in an incorrect image display of one frame. Also, there may be caused a problem of image distortion that when displaying a dynamic image, images in two frames are viewed as overlapped to a viewer.

In addition, a general driving method is limited to a fixed sequence in which a sequence of driving each of subfields and the number of subfields is predetermined, and these sequences become identical along the time axis. Accordingly, there is frequently caused a repeated occurrence of a specific gray level when displaying a dynamic image. If such occurrence arises in an area in which a bit carrier exists, a low frequency component is generated in the form of a partial flicker, resulting in a deterioration of image quality.

Now, the driving method will be described in more detail with reference to FIG. 6.

First, it is assumed that one frame is divided into eight subfields SF1, SF2 . . . SF8 and sustain pulses are set as 1, 2, 4, 8, 16, 32, 64 and 128, respectively and that thereafter, by combining suitably these subfields, gray level of $2^8$=256 are displayed.

The 63rd gray level lights-on all the subfields SF1 through SF6 and the 64th gray level lights-on only subfield SF7. As shown in FIG. 6, when light on occurs repeatedly at the 63rd gray level and the 64th gray level for every frame, the human eyes view the 127th gray level and the 0 gray level as light on repeatedly every frame. Thus, there occurs the problem that a low frequency component is formed for two adjacent frames and thusly a flicker is generated.

Furthermore, if scrolling a display of gray level in the inclined direction of brightness when displaying a dynamic image, a bright line and a dark line occur in a specific gray level and thusly the dynamic image is displayed as a false contour

SUMMARY OF THE INVENTION

Accordingly, an object of the present invention is to provide a driving method capable of preventing images in two frames from being viewed overlapping to a viewer when displaying a dynamic image by clarifying a boundary between adjacent frames in a multi-scan driving method within a sustaining pulse period.

Another object of the present invention is to provide a driving method capable of reducing an occurrence of a flicker and a false contour in a multi-scan driving method.

According to the present invention, there is provided a method of displaying a halftone image on a PDP display unit by using a frame division technique that divides each frame of halftone image into subfields with each having specific sustain pulses to provide a specific intensity level, comprising:

selecting display lines whose number is identical to the total number of said divided subfields, the position of said selected display lines being determined based on the number of sustain pulses set previously to said each subfields, addressing for designating pixels of selected display lines to be displayed and displaying each subfield allocated for the said selected display lines;

shifting by a predetermined number of display lines from said selected display lines as a sustain pulse period unit, selecting display lines, addressing for designating pixels of selected display lines to be displayed and displaying each subfield allocated for the said selected display lines; and repeating said shifting, said selecting, said addressing and said displaying steps until each of the subfields is completely displayed with regard to all display lines;

wherein display lines for all subfields of one frame have been completely displayed within an idle period, during which a subfield of the following frame is not displayed.

Moreover, the method is characterized in that said idle period is started by applying an erase pulse to the display lines where the display for all subfields has been already completed.

Also, the method is characterized in that the positions of the display lines which are firstly selected to display subfields of the following frame after completely displaying a previous frame are determined different from those of display lines which are firstly selected to display subfields of the previous frame.

BRIEF DESCRIPTION OF THE DRAWINGS

Now, embodiments of the present invention will be described in detail with reference to the accompanying drawings, wherein.

DETAILED DESCRIPTION OF THE PREFERRED EMBODIMENTS

Figure 7:
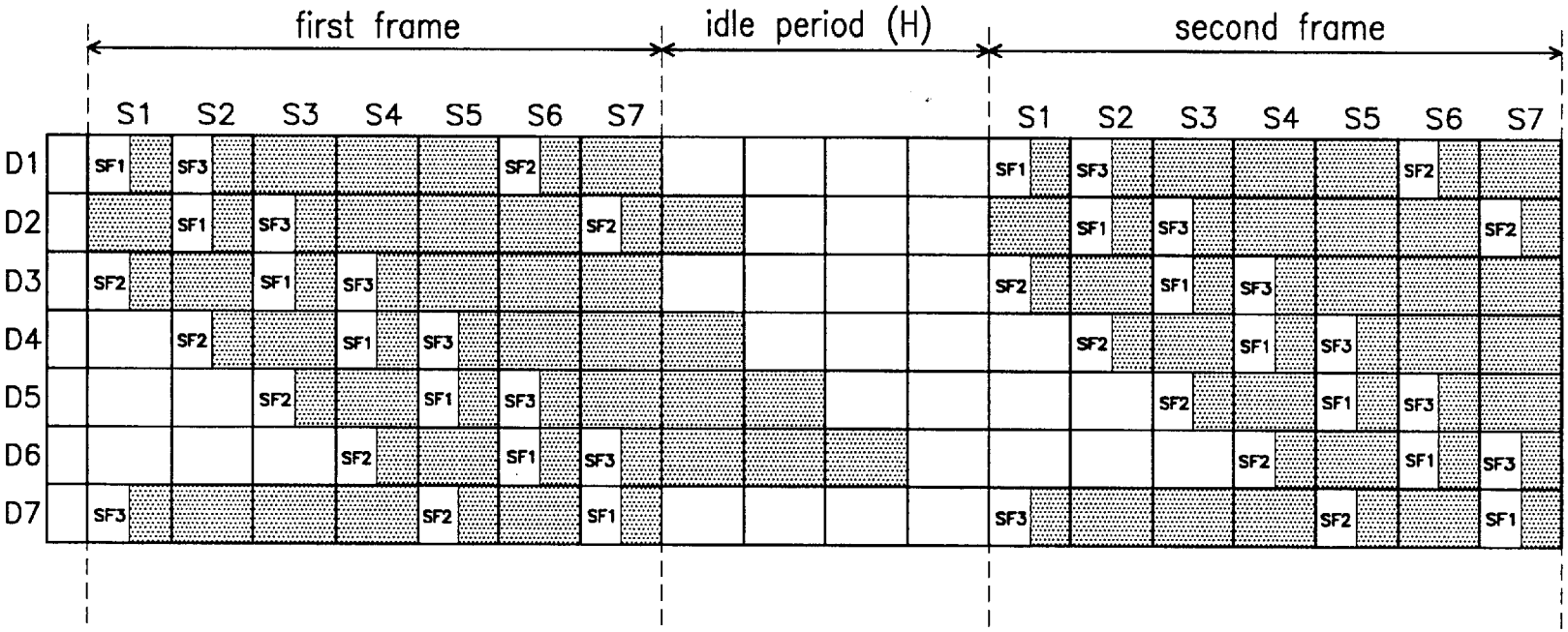
FIG. 7 is a timing diagram for displaying subfields between adjacent subfields in accordance with a first embodiment of the present invention.

FIG. 7 shows a timing diagram displaying subfields between two adjacent frames illustrating the first embodiment of the present invention. For convenience of a description, it is assumed that one frame divides into three subfields SF1, SF2 and SF3, sustain periods in the subfields SF1, SF2 and SF3 set as 1, 2 and 4, respectively and the number of display lines is 7. In practice, however, it is possible to divide one frame into six or eight more subfields and constitute display lines to have a conventional number of 480 lines. In FIG. 7, S1 through S7 represent the number of sustain pulses.

Since sustain periods (pulses) of each of subfields SF1, SF2 and SF3 are set as 1, 2 and 4 respectively, it is possible to select display lines D1, D3 and D7 in consideration of the sustain periods (pulses) set for each of the subfields SF1, SF2 and SF3. Of course, it is possible to select various combinations of display lines (D2, D4 and D1), (D3, D5 and D2), (D4, D6 and D3), (D5, D7 and D4), (D6, D1 and D5) and (D7, D2 and D6).

As shown in FIG. 7, the display lines D1, D3 and D7 are selected in consideration of the sustain pulses set for each of subfields SF1, SF2 and SF3 in the first sustain pulse period (S1). Then, the display of subfields SF1, SF2 and SF3 for the selected display lines D1, D3 and D7 is performed respectively. Next, the display lines D2, D4 and D1 which are allocated downwardly by one display line from the above-selected display lines are selected in the second sustain pulse period (S2). Then, the display of subfields SF1, SF2 and SF3 for the selected display lines D2, D4 and D1 is performed respectively. Next, the display lines D3, D5 and D2 which are allocated downwardly by one display line from the above-selected display lines are selected in the third sustain pulse period (S3). Then, the display of subfields SF1, SF2 and SF3 for the selected display lines D3, D5 and D2 is performed respectively. Next, the display lines D4, D6 and D3 which are allocated downwardly by one display line from the above-selected display lines are selected in the fourth sustain pulse period (S4). Then, the display of subfields SF1, SF2 and SF3 for the selected display lines D4, D6 and D3 is performed respectively. Next, the display lines D5, D7 and D4 which are allocated downwardly by one display line from the above-selected display lines are selected in the fifth sustain pulse period (S5). Then, the display of subfields SF1, SF2 and SF3 for the selected display lines D5, D7 and D4 is performed respectively. Next, the display lines D6, D1 and D5 which are allocated downwardly by one display line from the above-selected display lines are selected in the sixth sustain pulse period (S6). Then, the display of subfields SF1, SF2 and SF3 for the selected display lines D6, D1 and D5 is performed respectively. Next, the display lines D7, D2 and D6 which are allocated downwardly by one display line from the above-selected display lines are lastly selected in the seventh sustain pulse period (S7). Then, the display of subfields SF1, SF2 and SF3 for the selected display lines D7, D2 and D6 is performed respectively. Thereby, the display of one frame is completed.

After lastly selecting display lines D7, D2 and D6, the previously selected display lines complete sequentially display the subfields SF1, SF2 and SF3, respectively. At this time, the display lines, which have sequentially completed the display, do not perform a selection for displaying the next frame. After displaying subfield SF3 of the lastly selected display line D6, the display lines start the display of the next frame.

As a result, after the subfields SF1, SF2 and SF3 corresponding to one frame are completely displayed, there is provided an idle period H at every display line to the extent of at least the largest bit of subfield period.

Figure 8:
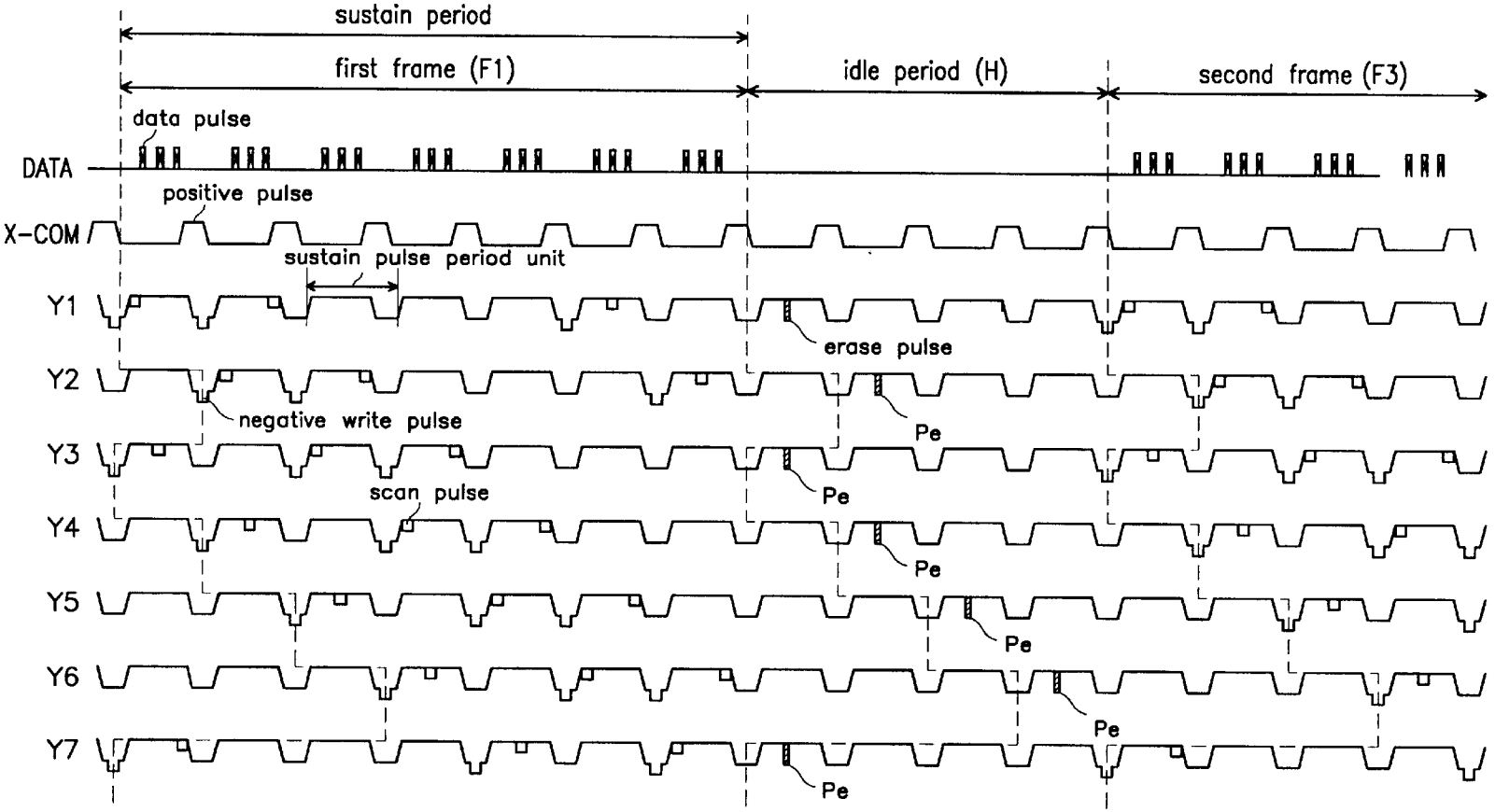
FIG. 8 shows an example of a pulse waveform applied to each electrode in a first embodiment of the present invention.

FIG. 8 is a pulse waveform diagram applied to each electrode in order to display a frame as shown in FIG. 7 and shows a driving method in accordance with a selectively erasing process.

Firstly, the selecting step of display lines will be described hereafter. As shown in FIG. 8, there is provided with a predetermined negative voltage to the Y electrodes Y1, Y2 and Y3 constituting the display lines D1, D3 and D7. At the same time, there is provided with a positive voltage to the common X electrodes constituting the display lines D1, D3 and D7. As a result, a write discharge to the display lines D1, D3 and D7 is performed and thereby, the display lines D1, D3 and D7 are selected.

Thereafter, in the addressing step, scan pulses generated from the Y scan-driving circuit are sequentially applied to the selected Y electrodes Y1, Y3 and Y7 in first sustaining pulse period. At the same time, data pulses generated from the data driving circuit in accordance with image data to be displayed are applied to data electrodes. If the data pulses are applied, a wall charge on the dielectric layer generated by the write discharge is erased. Thus, even if the sustaining pulse is applied, the sustaining discharge is not performed. If the data pulse is not applied, the wall charge cannot be erased. Accordingly, the write discharge in the above selecting step is still maintained.

Next, in the sustaining step, there is provided with the sustaining pulse to the Y electrodes (Y1, Y3 and Y7) and the common X electrodes constituting the display lines D1, D3 and D7. As the result, the sustaining discharge of the pixels that are designated in the addressing step is performed.

Continuously, by selecting the display lines D2, D4 and D1 which are allocated downwardly by one line from the display lines D1, D3 and D7 in the second sustaining pulse period, the shifting step is performed. At this time, there is provided with a predetermined negative voltage to the Y electrodes Y2, Y4 and Y1 constituting the display lines D2, D4 and D1. At the same time, there is provided with a positive voltage to the common X electrodes constituting the display lines D2, D4 and D1. As a result, a write discharge to the display lines D2, D4 and D1 is performed and thereby, the display lines D2, D4 and D1 are selected. The display line D1 is selected again among the display lines D1, D3 and D7 that were selected in the first sustaining pulse period, and thereby the display of subfield SF1 to the display line D1 is finished. Thereafter, the addressing and sustaining steps for the selected display lines D2, D4 and D1 are performed sequentially.

Continuously, by selecting the display lines D3, D5 and D2 which are allocated downwardly by one line from the display lines D2, D4 and D1 in the third sustaining pulse period, the shifting step is performed. At this time, there is provided with a predetermined negative voltage to the Y electrodes Y3, Y5 and Y2 constituting the display lines D3, D5 and D2. At the same time, there is provided with a positive voltage to the common X electrodes constituting the display lines D3, D5 and D2. As a result, a write discharge to the display lines D3, D5 and D2 is performed and thereby, the display lines D3, D5 and D2 are selected. The display line D3 is selected again among the display lines D1, D3 and D7 that were selected in the first sustaining pulse period, and thereby the display of subfield SF2 to the display line D3 is finished. Also, the display line D2 is selected again among the display lines D2, D4 and D1 that were selected in the second sustaining pulse period, and thereby the display of subfield SF1 to the display line D2 is finished. Thereafter, the addressing and sustaining steps for the selected display lines D3, D5 and D2 are performed sequentially.

Continuously, by selecting the display lines D4, D6 and D3 which are allocated downwardly by one line from the display lines D3, D5 and D2 in the fourth sustaining pulse period, the shifting step is performed. At this time, there is provided with a predetermined negative voltage to the Y electrodes Y4, Y6 and Y3 constituting the display lines D4, D6 and D3. At the same time, there is provided with a positive voltage to the common X electrodes constituting the display lines D4, D6 and D3. As a result, a write discharge to the display lines D4, D6 and D3 is performed and thereby, the display lines D4, D6 and D3 are selected. The display line D3 is selected again among the display lines D3, D5 and D2 that were selected in the third sustaining pulse period, and thereby the display of subfield SF1 to the display line D3 is finished. Also, the display line D4 is selected again among the display lines D2, D4 and D1 that were selected in the second sustaining pulse period, and thereby the display of subfield SF2 to the display line D4 is finished. Thereafter, the addressing and sustaining steps for the selected display lines D4, D6 and D3 are performed sequentially.

Continuously, by selecting the display lines D5, D7 and D4 which are allocated downwardly by one line from the display lines D4, D6 and D3 in the fifth sustaining pulse period, the shifting step is performed. At this time, there is provided with a predetermined negative voltage to the Y electrodes Y5, Y7 and Y4 constituting the display lines D5, D7 and D4. At the same time, there is provided with a positive voltage to the common X electrodes constituting the display lines D5, D7 and D4. As a result, a write discharge to the display lines D5, D7 and D4 is performed and thereby, the display lines D5, D7 and D4 are selected. The display line D4 is selected again among the display lines D4, D6 and D3 that were selected in the fourth sustaining pulse period, and thereby the display of subfield SF1 to the display line D4 is finished. Also, the display line D5 is selected again among the display lines D3, D5 and D2 that were selected in the third sustaining pulse period, and thereby the display of subfield SF2 to the display line D5 is finished. Also, the display line D7 is selected again among the display lines D1, D3 and D7 that were selected in the first sustaining pulse period, and thereby the display of subfield SF3 to the display line D7 is finished Thereafter, the addressing and sustaining steps for the selected display lines D5, D7 and D4 are performed sequentially.

Continuously, by selecting the display lines D6, D1 and D5 which are allocated downwardly by one line from the display lines D5, D7 and D4 in the sixth sustaining pulse period, the shifting step is performed. At this time, there is provided with a predetermined negative voltage to the Y electrodes Y6, Y1 and Y5 constituting the display lines D6, D1 and D5. At the same time, there is provided with a positive voltage to the common X electrodes constituting the display lines D6, D1 and D5. As a result, a write discharge to the display lines D6, D1 and D5 is performed and thereby, the display lines D6, D1 and D5 are selected. The display line D1 is selected again among the display lines D2, D4 and D1 that were selected in the second sustaining pulse period, and thereby the display of subfield SF3 to the display line D1 is finished. Also, the display line D5 is selected again among the display lines D5, D7 and D4 that were selected in the fifth sustaining pulse period, and thereby the display of subfield SF1 to the display line D5 is finished. Also, the display line D6 is selected again among the display lines D4, D6 and D3 that were selected in the fourth sustaining pulse period, and thereby the display of subfield SF2 to the display line D6 is finished. Thereafter, the addressing and sustaining steps for the selected display lines D6, D1 and D5 are performed sequentially.

Continuously, by selecting the display lines D7, D2 and D6 which are allocated downwardly by one line from the display lines D6, D1 and D5 in the seventh sustaining pulse period, the shifting step is performed. At this time, there is provided with a predetermined negative voltage to the Y electrodes Y7, Y2 and Y6 constituting the display lines D7, D2 and D6. At the same time, there is provided with a positive voltage to the common X electrodes constituting the display lines D7, D2 and D6. As a result, a write discharge to the display lines D7, D2 and D6 is performed and thereby, the display lines D7, D2 and D6 are selected. The display line D2 is selected again among the display lines D2, D4 and D1 that were selected in the third sustaining pulse period, and thereby the display of subfield SF3 to the display line D1 is finished. Also, the display line D6 is selected again among the display lines D6, D1 and D5 that were selected in the sixth sustaining pulse period, and thereby the display of subfield SF1 to the display line D6 is finished. Also, the display line D7 is selected again among the display lines D5, D7 and D4 that were selected in the fifth sustaining pulse period, and thereby the display of subfield SF2 to the display line D7 is finished. Thereafter, the addressing and sustaining steps for the selected display lines D7, D2 and D6 are performed sequentially.

Figure 9:
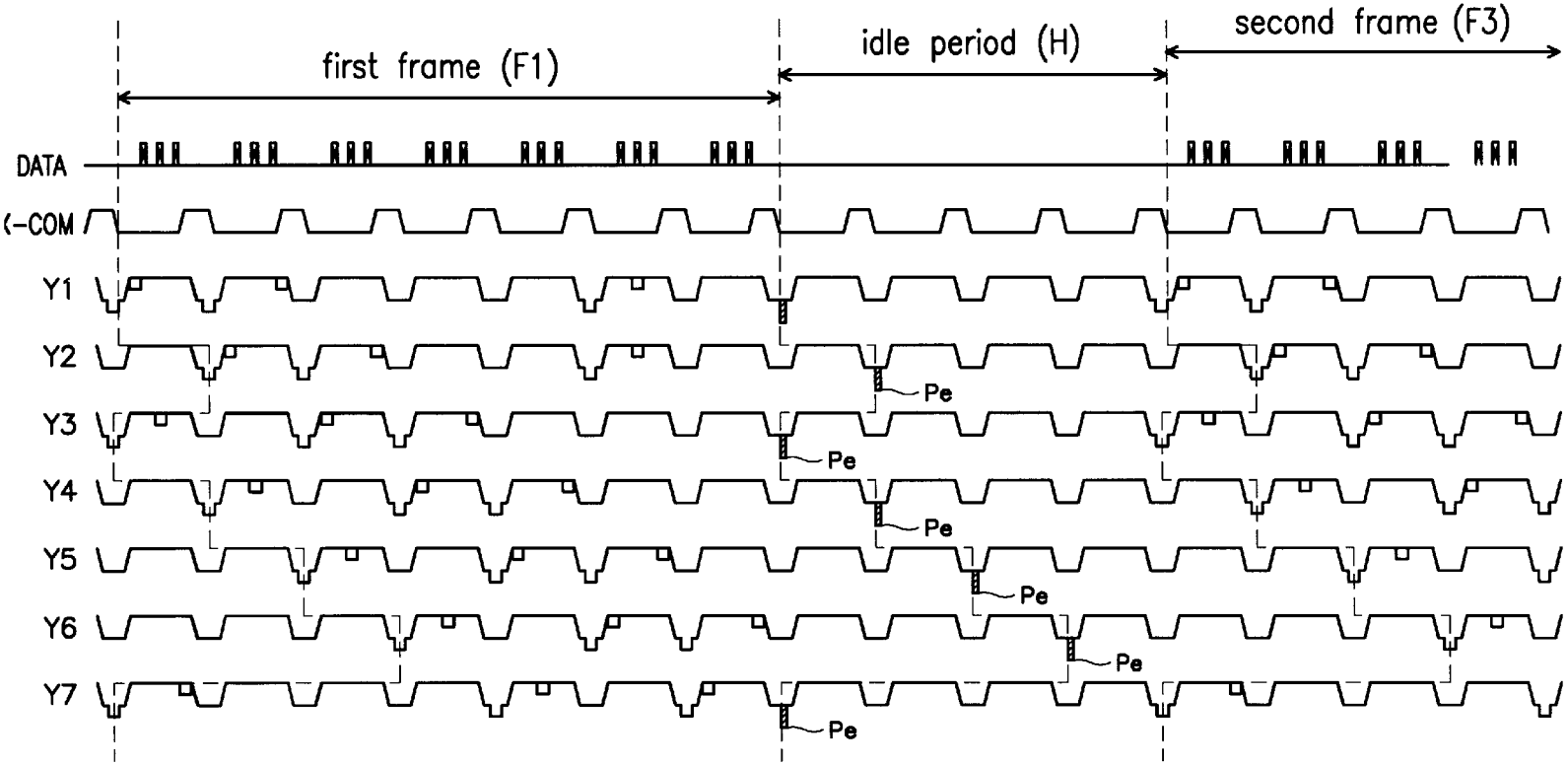
FIG. 9 shows another example of a pulse waveform applied to each electrode in a first embodiment of the present invention.

In the above described process, erase pulses (Pe) generated from the Y electrode scan driving circuit are applied to the Y electrodes after the total number of sustaining pulses of the corresponding frame are applied to every display line, and thereby wall charge accumulated during the sustain discharge is erased. As the result, the display of the corresponding frame for every display line is finished. The erase pulses (Pe) can be applied to the Y electrode within a sustaining pulse period of the Y electrode as shown in FIG. 8 and also immediately after a sustaining pulse is applied to the X electrode as shown in FIG. 9. The display of the next frame starts after erase pulses (Pe) to all the display lines are applied.

Accordingly, an idle period H for all the display lines is from when applying erase pulse to when starting the display of the next frame. That is, the length of the idle period H depends on a display period of a largest bit of subfield SF3 allocated in the display lines that are lastly selected. Therefore, it is desirable to shorten the idle period H. By dividing the largest bit of subfield into a plurality of subfields, the idle period H can be shortened.

Figure 10A:
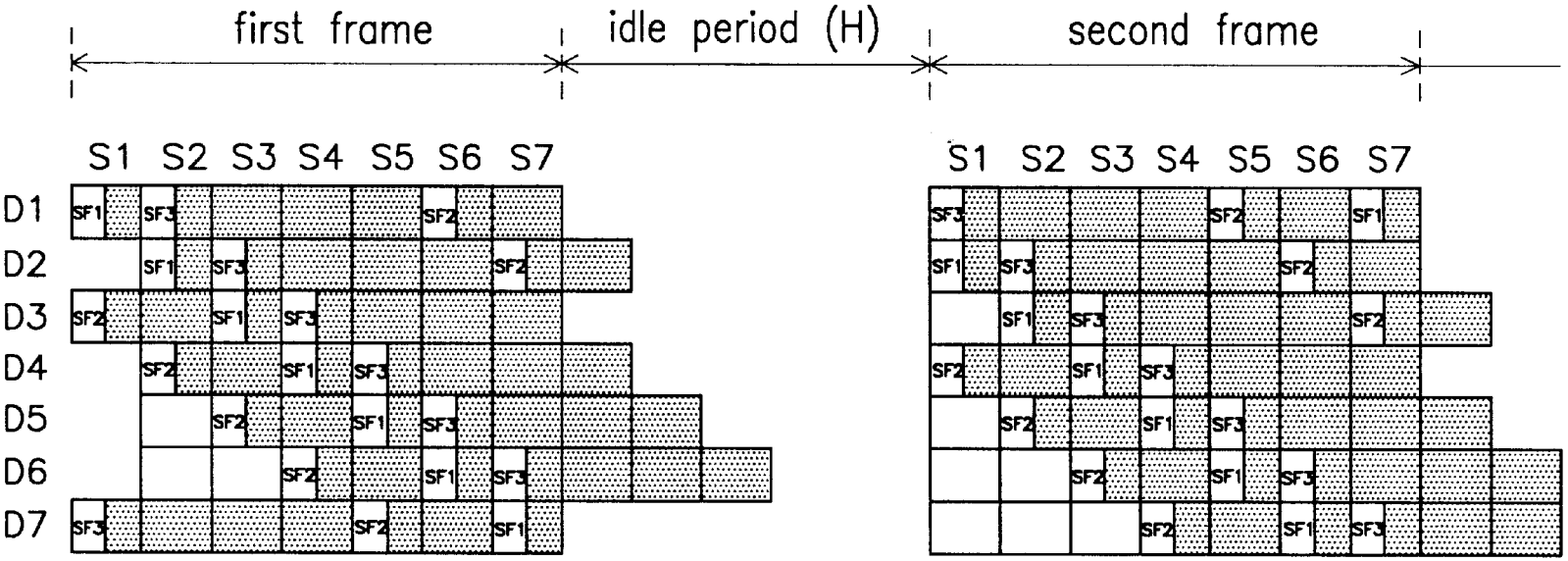
FIGS. 10*a* and 10*b* are timing diagrams for displaying subfields between adjacent subfields in accordance with a second embodiment of the present invention.
Figure 10B:
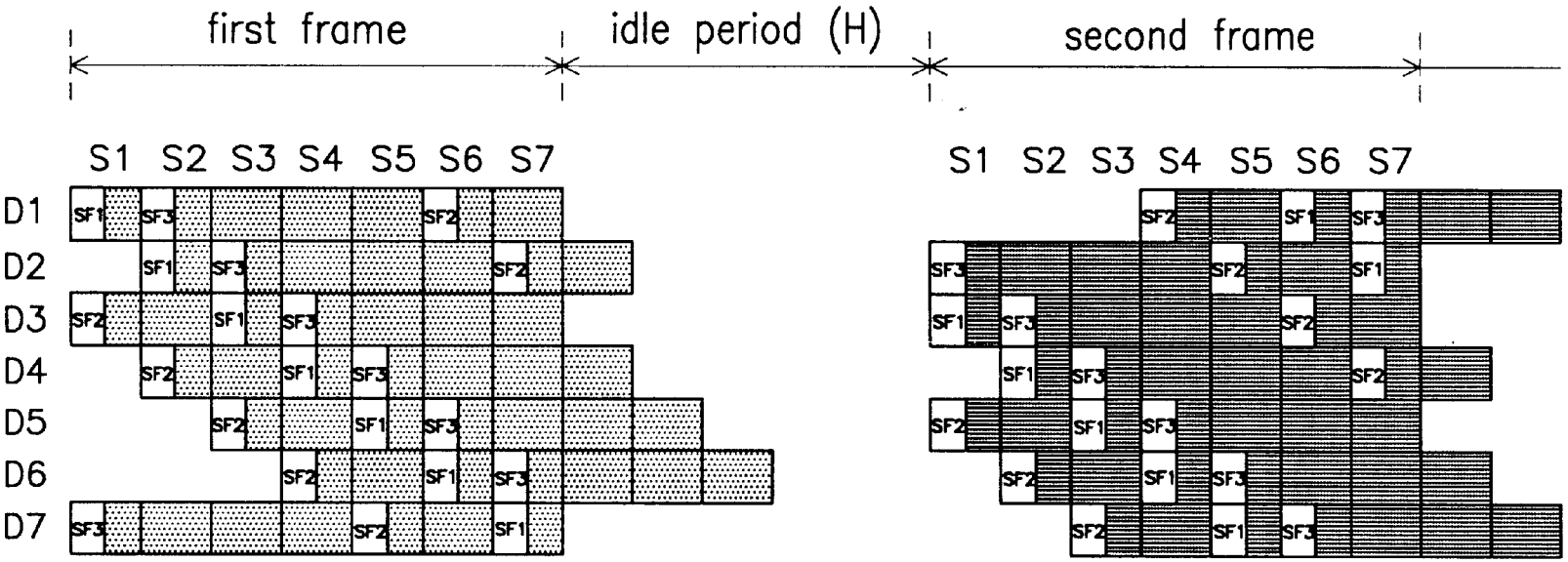

FIGS. 10*a* and 10*b* show a driving method in accordance with a second embodiment of the present invention. As explained in FIG. 7, when displaying one frame of an image, three display lines identical to the number of subfields can be selected firstly. Also, the position of display lines selected can be determined as display lines D1, D3 and D7 with regard to each of subfields SF1, SF2 and SF3 in a consideration of the sustain periods 1, 2 and 4. At this time, the positioning of the display lines in consideration of sustain periods designated on each subfield is the same as the allocating of each subfield to the display lines. That is, if selecting one display line D1 of seven display lines and allocating the subfield SF1 for the display line D1, other display line D7 or D2 positioned above or below by one line from the display line D1 should be selected.

In practice, even though the display line D2 is positioned below by one line from the display line D1, the selecting of the display line D2 can be considered in case that the scanning direction moves upwardly. Next, if selecting one display line D7 of seven display lines and allocating the subfield SF3 for the display line D7, the remaining display line D3 can be automatically selected, and thereby subfield F2 for the display line D3 is allocated.

As described above, once the position of the display lines selected firstly is determined in accordance with the number of sustain pulses set to each of the subfields, the displaying order of each of the subfields SF1, SF2 and SF3 is constantly maintained until the display of one frame is completed.

Figure 1:
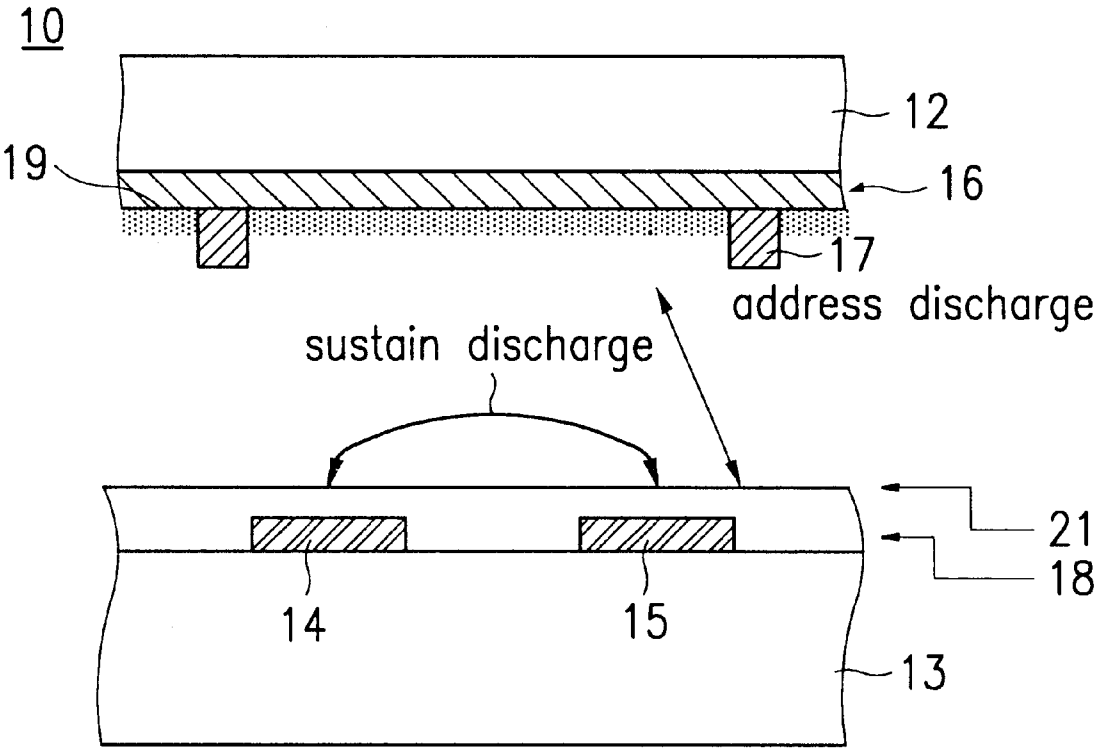
Fig.1 (prior art)
FIG. 1 is a schematic sectional view of a discharge cell of a conventional plasma display panel.
Figure 2:
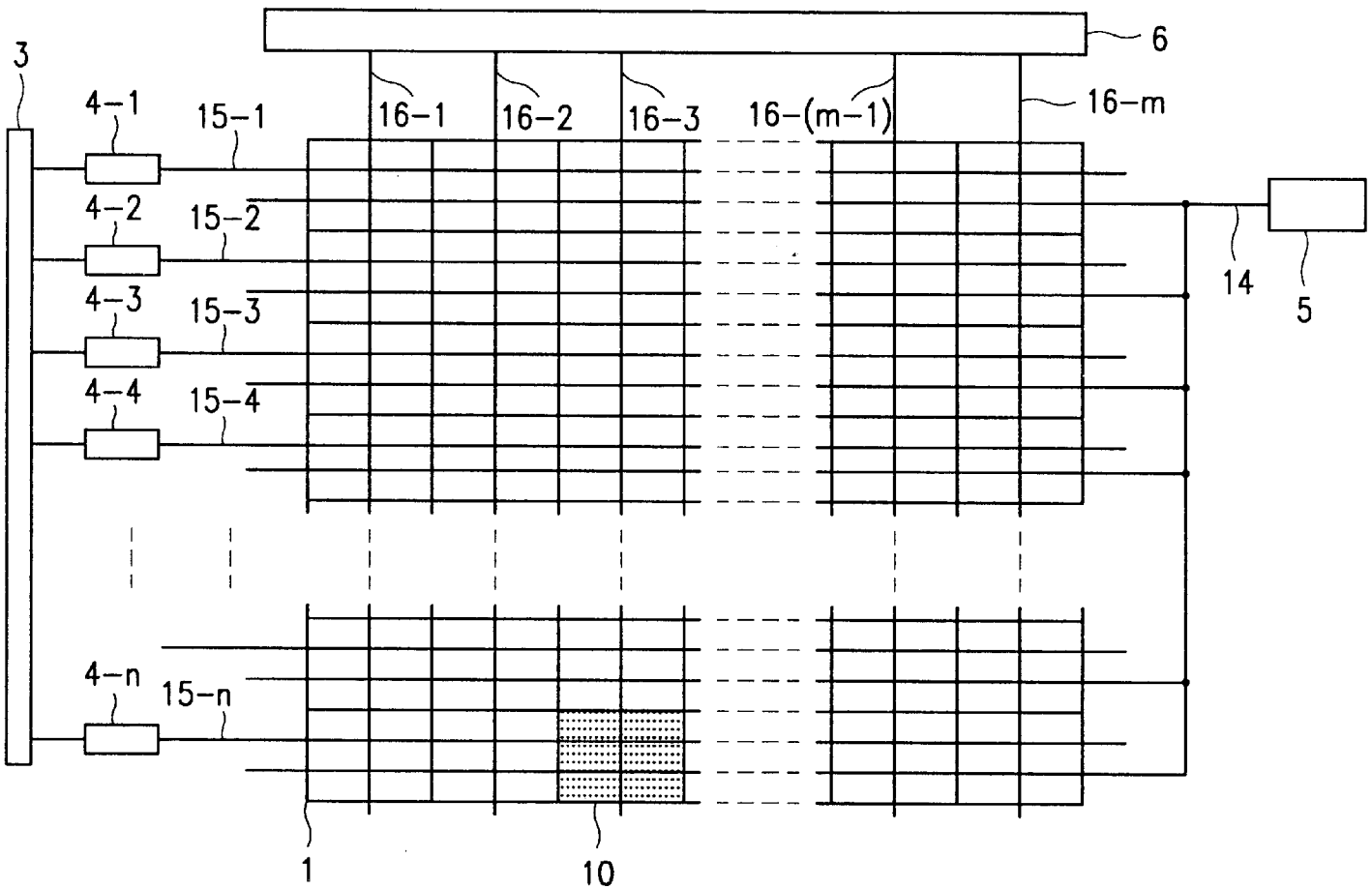
Fig.2 (prior art)
FIG. 2 is a plan view of a conventional three-electrode type plasma display panel.
Figure 3:
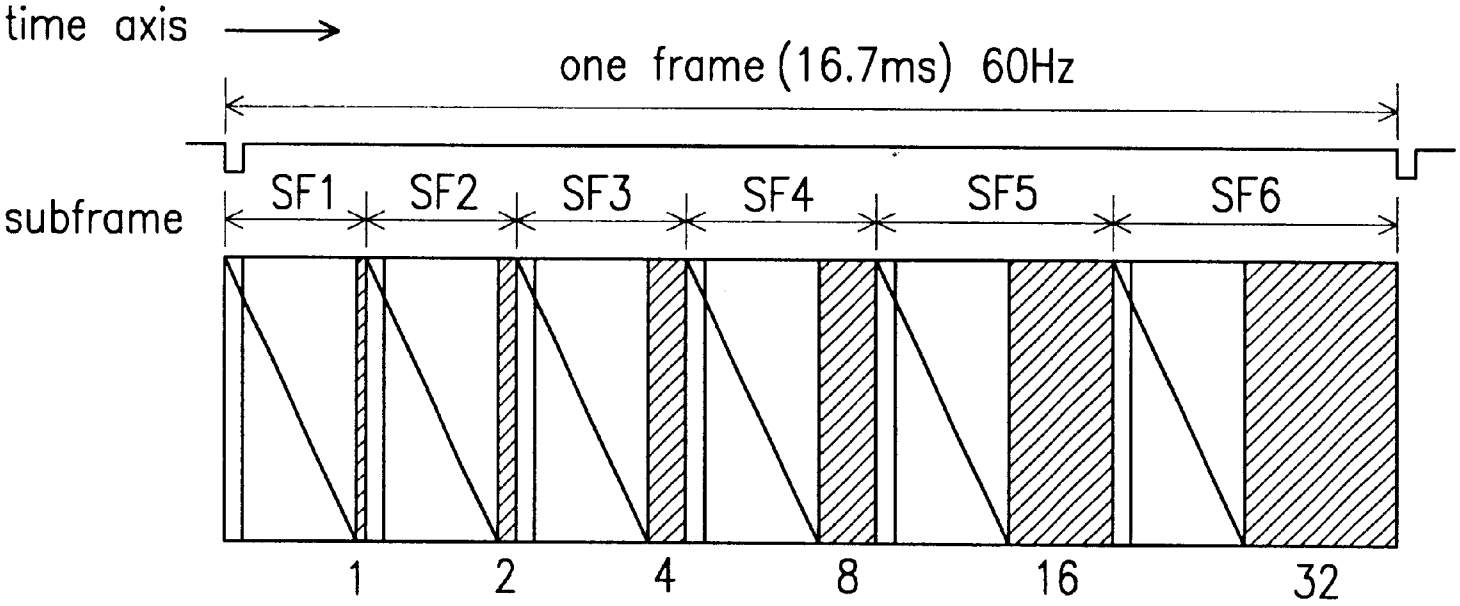
Fig.3 (prior art)
FIG. 3 is a frame structure explaining a prior art driving method.
Figure 4:
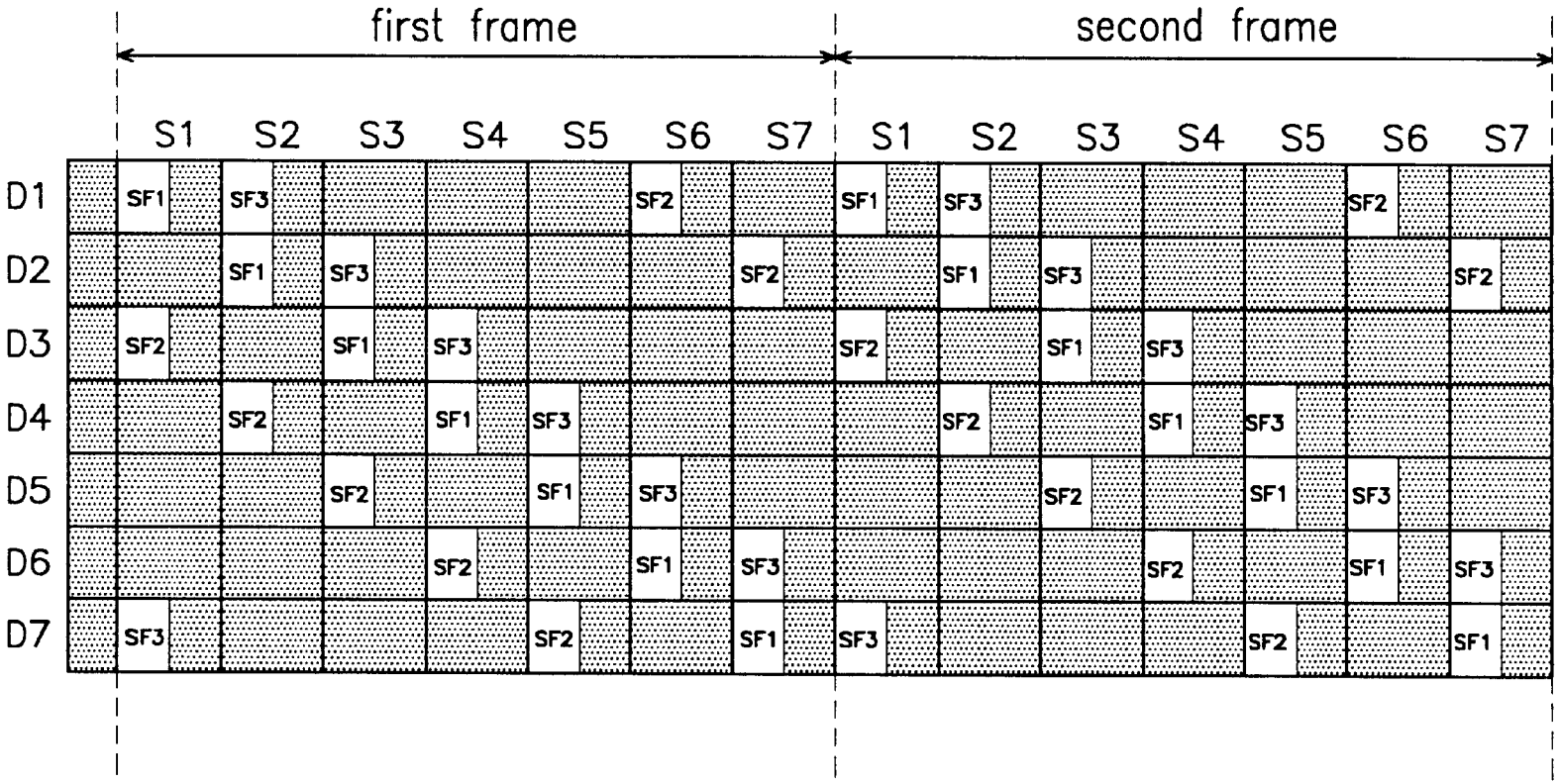
Fig.4 (prior art)
FIG. 4 is a timing diagram illustrating division of an image frame into subfields adapted for a conventional driving method.
Figure 5:
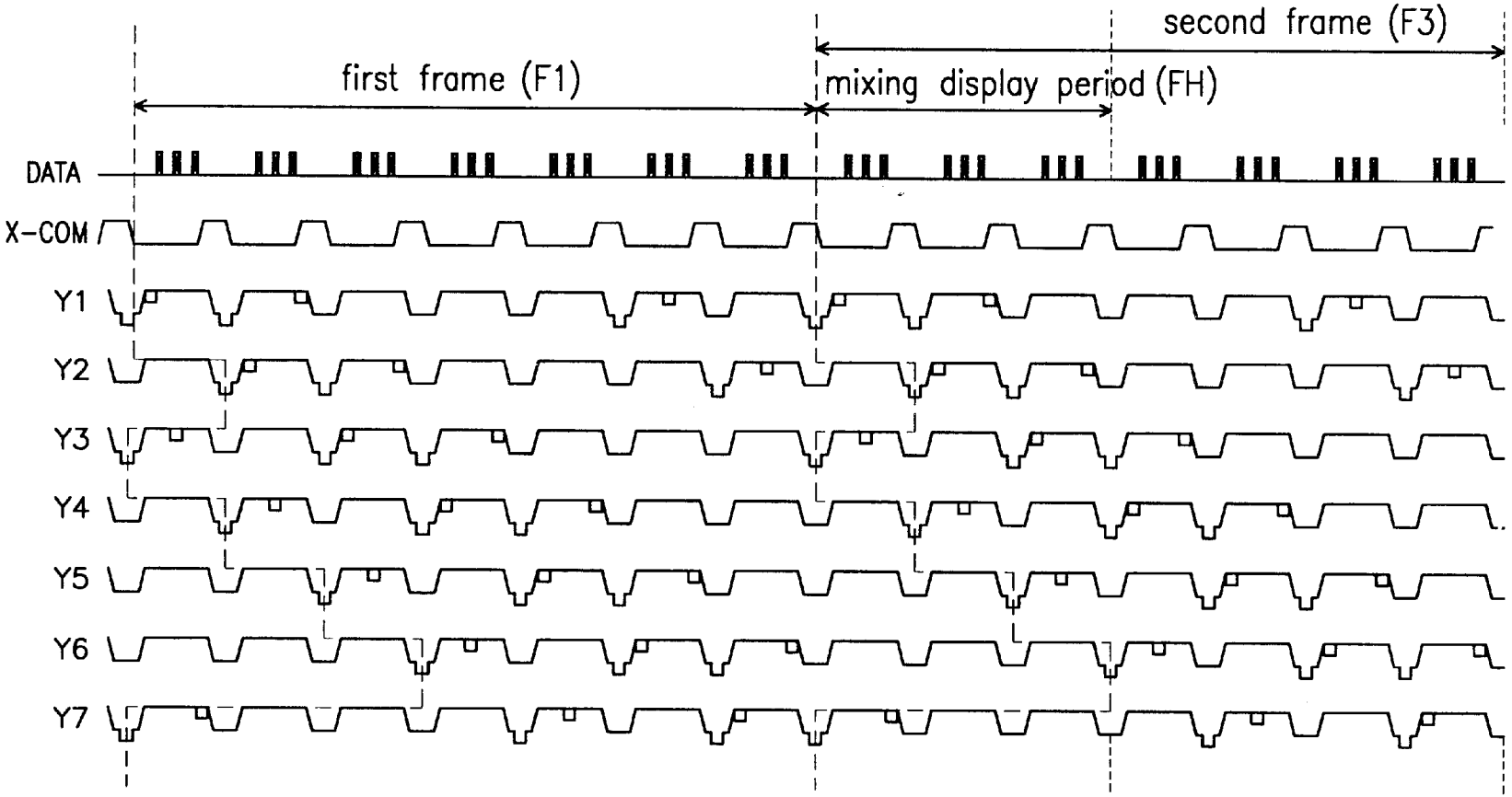
Fig.5 (prior art)
FIG. 5 is a pulse waveform diagram applied by each electrode to display a frame in accordance with a conventional method.
Figure 6:
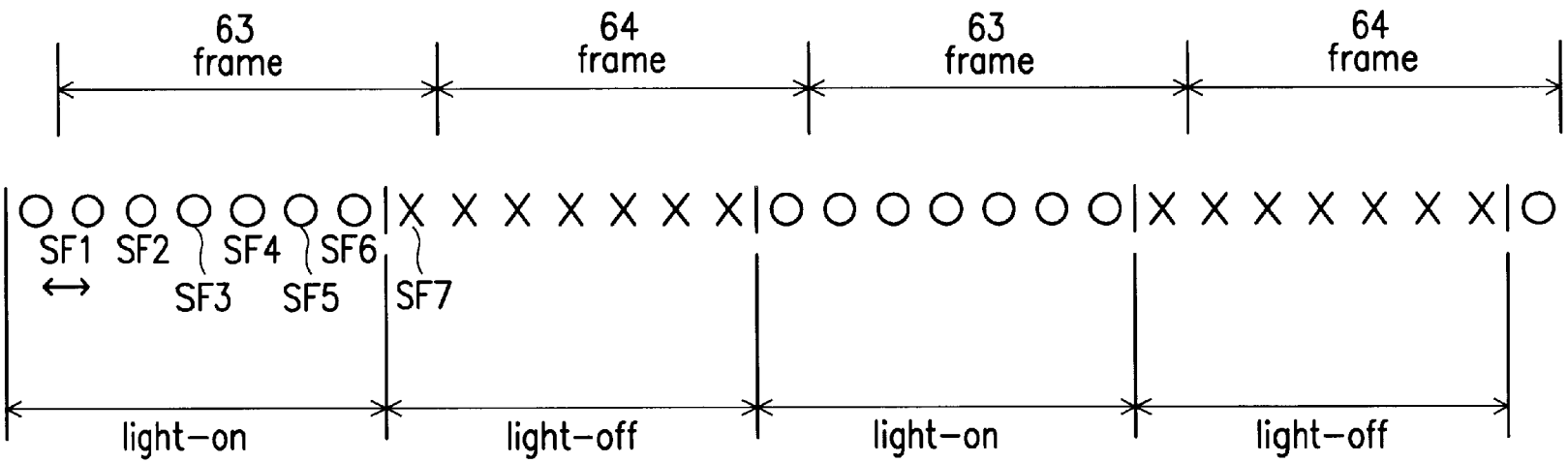
Fig.6 (prior art)
FIG. 6 is a diagram illustrating a problem encountered by a conventional plasma display panel.

In FIG. 7, there is shown that the position of display lines for displaying a next frame is selected identical to the previous frame. However, in the case that a specific gray level is repeatedly generated when displaying a dynamic image as shown in FIG. 6, a low frequency ingredient occurs in an area in which a bit carry exists. Thus, there is caused a problem that the low frequency ingredient is generated in the form of a partial flicker, resulting in deterioration of image quality.

According to the second embodiment of the present invention, in order to solve such problem, the position of display lines selected firstly to display the next frame is different from that of the display lines selected firstly to display the previous frame.

For example, as shown in FIG. 10*a*, the position of display lines selected firstly in the previous frame are display lines D1, D3 and D7 allocated to the subfields SF1, SF2 and S3, respectively. On the other hand, the position of display lines selected firstly in the next frame are display lines D1, D2 and D4 allocated to the subfields SF3, SF1 and SF2, respectively. Likewise, as shown in FIG. 10*b*, the position of display lines selected firstly in the next frame are display lines D2, D3 and D5 allocated to the subfields SF3, SF1 and SF2, respectively.

In this way, a combination of display lines to be selected initially in a frame can be selected as any one of combinations of n×N!, wherein n is the number of display lines and N is total number of subfields of one frame. Accordingly, a combination of display lines to be selected initially in the next frame can be selected as any one of [n×N!]−1 combinations which excepts the combination selected in the previous frame. According to the second embodiment of the present invention, it is possible to display sub fields in a different order at every frame.

Figure 11:
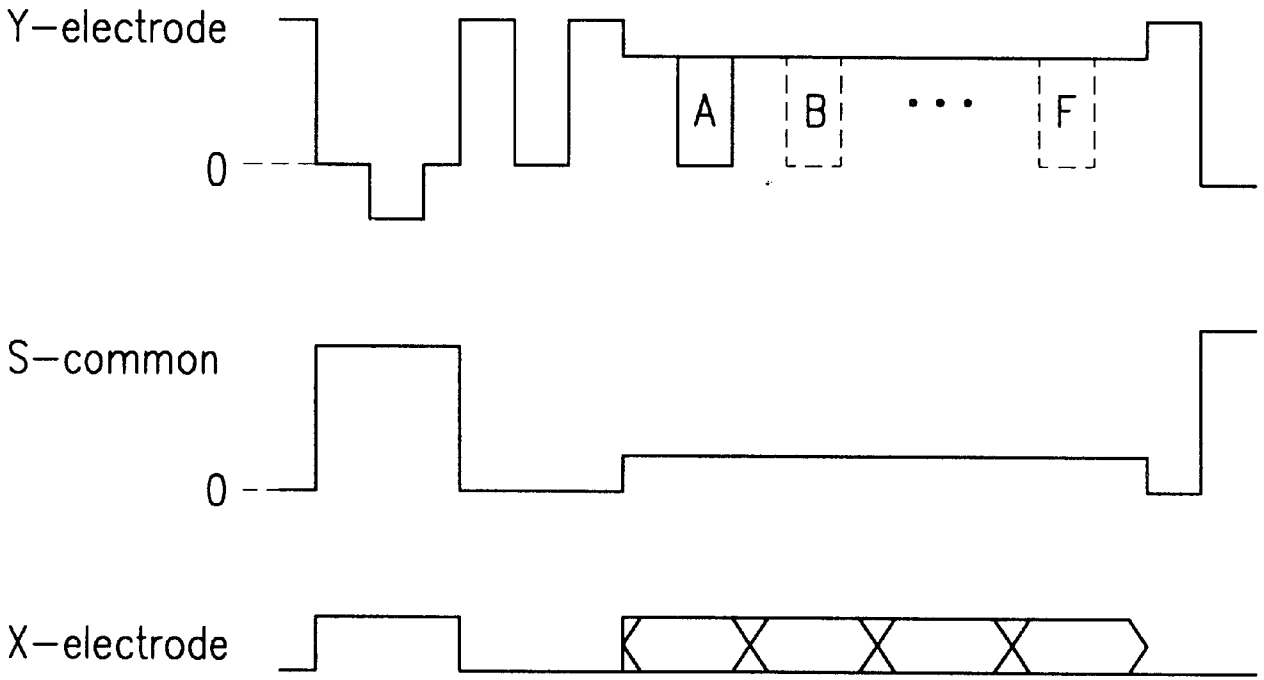
FIG. 11 is an example of a pulse waveform diagram applied to application examples of the present invention.

Until now, even though the driving method according to the present invention was described based on a selective erase process, as shown in FIG. 11, it can be applicable to a selective writing process comprising writing discharge for the display lines selected, erase discharge for erasing wall charge accumulated on a dielectric layer, addressing discharge for designating pixels to be displayed, and sustain discharge for displaying pixels designated.

As mentioned above, according to the present invention, since after completing a display of one frame with respect to all display lines, a display for the next frame is initiated, and it is possible to prevent images in two frames being viewed to a viewer in an overlapped shape when displaying a dynamic image.

Moreover, even when a specific gray level is repeatedly displayed, since the display order of subfields of every frame varies, the occurrence of a low frequency ingredient can be prevented. Many different embodiments of the present invention can by provided without departing from the spirit and scope of the present invention which is not limited to the specific embodiments described in the specification. Also, the present invention can be applied to various kinds of flat display devices such LCD, FED, EL and the like.

What is claimed is:

1. A method of driving a plasma display panel, said display panel comprising a pair of plates spatially facing each other; a plurality of scan sustain electrodes and common sustain electrodes arranged alternately in parallel with each other on one plate of said pair of plates; a plurality of display lines formed by a pair of one scan sustain electrode and the common sustain electrode; a dielectric layer covering said scan sustain electrodes and said common sustain electrodes; a plurality of data electrodes arranged in the direction crossing over said plurality of display lines; and a plurality of pixels defined on crossing points between said display lines and said data electrodes, said method comprising:

a) dividing a frame displaying a single picture into a plurality of subfields and allocating a specified number of sustain pulses to the respective subfield;

b) selecting display lines by applying a writing discharge pulse to scan-sustain electrodes of display lines corresponding to the total number of said divided subfields, the position of said display lines being determined based on the number of sustain pulses allocated to each said subfields;

c) initializing a discharge condition of all the pixels of said selected display lines by applying an erase pulse to the scan-sustain electrode of said selected display lines;

d) performing addressing discharge by applying a plurality of scan pulses to the scan-sustain electrodes of the selected display lines and at the same time applying data pulse to the data electrode in accordance with an input signal in order to designate pixels to be displayed within one sustain pulse period, said scan pulses having different phases, and thereby the wall charges being accumulated on the dielectric layer;

e) performing a sustain discharge by means of sustain pulses applied to the scan-sustain electrodes and the common sustain electrodes, whereby pixels in which wall charge is accumulated perform the sustain discharge and pixels in which wall charge is not accumulated do not perform the sustain discharge;

f) shifting the display lines by selecting display lines by a predetermined number of said display lines which are downwardly or upwardly from said selected display lines for at least a sustain pulse period unit, said selecting of display lines being performed by applying a writing discharge pulse to scan-sustain electrodes; initializing the discharge condition of all the pixels of said selected display lines by applying an erase pulse to the scan-sustain electrode of said selected display lines; performing addressing discharge by applying a plurality of scan pulses to the scan-sustain electrodes of the selected display lines and at the same time applying data pulse to the data electrode; and performing sustain discharge by means of sustain pulses applied to the scan-sustain electrodes and common sustain electrodes;

g) repeating said shifting, said selecting, said initializing, said performing addressing discharge and said performing sustain discharge in said step I) until each of said subfields is completely displayed with regard to all display lines; and h) performing erasing discharge by applying an erase pulse to the corresponding display line after a total number of sustain pulses for one frame, substantially contributing to the display, are applied, before a display of a following frame; wherein one of said bits of subfield is largest, an idle period being at least equal to or longer than a display period of the one largest bit of subfield, said idle period being from when all subfields allocated to one of the display lines of one frame have been completely displayed to when said one of said display lines for subfields of said following frame start to display; and wherein the displaying order of the subfields in one frame is determined in accordance with positions of the display lines selected firstly, and said displaying order of the sub fields in the following frame differs from that of the subfields in the previous frame.

2. A method of driving a plasma display panel according to claim 1 wherein the displaying order of subfields of said frame is selected from combinations of number of display lines allocated to one frame)×N(the total number of subfields constituting one frame).

* * * * *